US012022963B2

(12) United States Patent
Veettil et al.

(10) Patent No.: US 12,022,963 B2
(45) Date of Patent: Jul. 2, 2024

(54) BULK DISPENSER

(71) Applicant: Trade Fixtures, LLC, Little Rock, AR (US)

(72) Inventors: Shaji Kulangara Veettil, Little Rock, AR (US); Ronald Brundick, Roland, AR (US); Christoper Lyons, Western Springs, IL (US); Austen Siwiec, Naperville, IL (US); Craig Pavlich, Glen Ellyn, IL (US)

(73) Assignee: Trade Fixtures, LLC, Little Rock, AR (US)

( * ) Notice: Subject to any disclaimer, the term of this patent is extended or adjusted under 35 U.S.C. 154(b) by 307 days.

(21) Appl. No.: 17/546,792

(22) Filed: Dec. 9, 2021

(65) Prior Publication Data

US 2022/0257031 A1 Aug. 18, 2022

Related U.S. Application Data

(60) Provisional application No. 63/152,024, filed on Feb. 22, 2021, provisional application No. 63/124,426, filed on Dec. 11, 2020.

(51) Int. Cl.
*A47F 1/03* (2006.01)
*A47F 1/10* (2006.01)

(52) U.S. Cl.
CPC ..... *A47F 1/10* (2013.01)

(58) Field of Classification Search
CPC ..... A47F 1/03; A47F 1/10; B65D 83/06
See application file for complete search history.

(56) References Cited

U.S. PATENT DOCUMENTS

| | | | |
|---|---|---|---|
| 4,473,175 | A | 9/1984 | Zengaffinen et al. |
| 4,903,866 | A | 2/1990 | Loew |
| 5,285,925 | A | 2/1994 | Leight |
| 5,437,393 | A | 8/1995 | Blicher et al. |
| 5,613,464 | A | 3/1997 | Petzel |
| 6,182,864 | B1 | 2/2001 | Elmore |
| 6,241,123 | B1 | 6/2001 | Elmore |
| 6,257,464 | B1 | 7/2001 | Dalton et al. |
| 8,448,602 | B2 | 5/2013 | Lytle |

(Continued)

FOREIGN PATENT DOCUMENTS

| | | | |
|---|---|---|---|
| EP | 3669707 | A1 | 6/2020 |
| EP | 3542678 | B1 | 11/2020 |

OTHER PUBLICATIONS

International Search Report and Written Opinion for PCT/US21/62847, mailed Apr. 11, 2022.

*Primary Examiner* — Paul J Gray
(74) *Attorney, Agent, or Firm* — Andrus Intellectual Property Law, LLP

(57) ABSTRACT

A gravity-feed dispenser for storage and dispensing of bulk material includes a compartment. A gate separates the compartment from a spout. The gate is operable to open and close to selectively permit bulk material to pass from the compartment into the spout. An actuator is movable relative to the spout and mechanically connected to the gate such that movement of the actuator operates the gate to reversibly open and close. Movement of the actuator concurrently reversibly positions the actuator to a dispensing position below a dispensing end of the spout, wherein dispensed bulk material passes through the spout and the actuator.

12 Claims, 15 Drawing Sheets

(56) References Cited

U.S. PATENT DOCUMENTS

| | | | | |
|---|---|---|---|---|
| 8,708,199 | B2 | 4/2014 | James | |
| 8,870,024 | B2 * | 10/2014 | Mendes | A47F 1/03 222/413 |
| 9,278,788 | B2 | 3/2016 | Brundick | |
| 10,450,152 | B2 | 10/2019 | Brundick et al. | |
| 10,665,051 | B2 | 5/2020 | Conway | |
| 11,051,636 | B2 * | 7/2021 | Sunesson | A47F 1/03 |
| 2005/0269366 | A1 * | 12/2005 | Brundick | B65B 37/04 222/185.1 |
| 2010/0282770 | A1 | 11/2010 | Mendes et al. | |
| 2014/0117036 | A1 * | 5/2014 | Smith | A47F 1/10 221/1 |
| 2019/0092617 | A1 | 3/2019 | Brundick et al. | |
| 2020/0090114 | A1 | 3/2020 | Conway | |
| 2020/0189836 | A1 | 6/2020 | Sunesson et al. | |
| 2020/0193758 | A1 | 6/2020 | Conway | |
| 2021/0106147 | A1 | 4/2021 | Sunesson et al. | |

* cited by examiner

BULK DISPENSER

CROSS-REFERENCE TO RELATED APPLICATIONS

The present application claims priority of U.S. Provisional Patent Application No. 63/124,426 filed on Dec. 11, 2020. The present application also claims priority of U.S. Provisional Patent Application No. 63/152,024 filed on Feb. 22, 2021. The present application incorporates the disclosure of these applications by reference in their entireties.

BACKGROUND

The present disclosure relates to the field of bulk dispensing bins, particularly those for use by consumers at point-of-sale installations. More specifically, the present disclosure relates to features to limit direct contact between a user and the dispenser.

Bulk dispensers, and more particularly gravity-feed bulk dispensers are known and used in commercial settings for self-service portioning of bulk materials, for example foods. Traditionally, gravity feed bins for dispensing bulk materials are used to dispense a wide variety of materials having a range of sizes and aggregate make-ups as diverse as hardware components (e.g. nuts and bolts) or food (e.g. nuts, cereals, grains, pastas, coffee (beans or ground), dried soup mix, candies, spices). Generally, the bins include an enclosure having an inlet at an upper end through which the enclosure is filled, an outlet at a lower end for dispense of the material, and a flow control device located between the upper and lower openings for controlling an amount of materials being dispensed. In operation, as the material is being dispensed gravity pulls the remaining material in the enclosure towards the lower end to replace dispensed material. These types of bins generally include a downwardly curving inner wall that forms a chute to channel the dispensed materials in a receptacle adjacent the outlet.

Examples of known gravity feed bins are found in U.S. Pat. No. 4,903,866 entitled, "Gravity Dispensing Bin System"; U.S. Pat. No. 5,437,393, entitled, "Apparatus for Delivering Bulk Foods"; U.S. Pat. No. 6,182,864 entitled, "Bulk Food Dispensing Apparatus"; U.S. Pat. No. 6,241,123 entitled, "Bulk Food Dispensing Apparatus"; U.S. Pat. No. 10,450,152 entitled, "Expandable Gravity-Feed Bin"; and US Pat. App. Pub. No. 2019/0092617 entitled, "Expandable Gravity-Feed Bin." Each of these are incorporated by reference in their entireties.

BRIEF DISCLOSURE

In an example of a gravity-feed dispenser for storage and dispensing of bulk material, the gravity-feed dispenser includes a compartment configured to receive and store bulk material. A spout is connected at one end to the compartment and open at a dispensing end. A gate separates the compartment from the spout. The gate is operable to open and close to selectively permit bulk material to pass from the compartment into the spout. An actuator is movable relative to the spout and mechanically connected to the gate such that movement of the actuator operates the gate to reversibly open and close. Movement of the actuator concurrently reversibly positions the actuator to a dispensing position below the dispensing end of the spout, wherein dispensed bulk material passes through the actuator.

In further examples of the gravity-feed dispenser, the actuator includes a spout. The actuator is pivotably connected to the spout of the dispenser and wherein in the dispensing position, the spout of the actuator is positioned below the spout of the dispenser. A pivot housing is releasably secured about the spout of the dispenser. The actuator is pivotably secured to the pivot housing. At least one handle arm is mechanically connected to the gate. The at least one handle arm and the gate rotate about a same axis with respect to the compartment to open and close the gate. A linkage is pivotably connected between the at least one handle arm and the actuator. The at least one handle arm is a pair of handle arms with a first end of the linkage pivotably secured between the pair of handle arms, and wherein the actuator comprises a pair of lever projections that extend from the actuator, a second end of the linkage pivotably secured between the pair of lever projections. A force applied to the actuator rotates the actuator relative to the spout of the dispenser and the force is transferred to the gate through the linkage and the pair of handle arms to open the gate. The linkage includes identifying information regarding the contents of the dispenser.

In additional examples of the gravity-feed dispenser, a spout extension may extend away from the spout of the actuator. A bowl adapter can be secured about the spout of the actuator. The bowl adapter may define an aperture configured to receive the spout of the actuator. The bowl adapter includes a sidewall configured to engage an interior surface of a bowl. The spout of the actuator may further include a lip configured to abut a surface of the bowl adapter. The bowl adapter and the spout of the actuator further include engagement features configured to retain the bowl adapter in engagement with the spout of the actuator. A bowl adapter may be secured the actuator. The bowl adapter may be configured for engagement with a bowl.

An example of an actuator assembly for a gravity-feed dispenser includes a pivot housing configured for attachment about a spout of the gravity-feed dispenser. An actuator is pivotably attached to the pivot housing at a pivot point. The actuator includes a pair of lever arms extending away from the pivot point. A pair of handle arms are configured for rotatable connection to the gravity-feed dispenser. A linkage is pivotably connected at a first end to the pair of handle arms and pivotably connected at a second end to the pair of lever arms. The linkage is configured to movably connect the actuator with the pair of handle arms.

In examples of the actuator assembly, the actuator further includes a tubular spout extending away from the pivot housing. The actuator assembly may further include a bowl adapter configured to move with the actuator assembly and to receive an indirect force applied thereto through a bowl placed in engagement with the bowl adapter. The actuation assembly may further include a gate engaged with the pair of handle arms and configured to rotate with the handle arms. The linkage may further be configured to extend through the interior of the spout of the dispenser.

An example of a method of retrofitting a gravity feed dispenser that includes a handle, a gate, a compartment, and a spout to include an actuation assembly includes removing the handle from the gravity feed dispenser and removing the handle from mechanical connection to the gate. The pair of handle arms are secured through holes in the dispenser through which the handle was mechanically connected to the gate. The pair of handle arms are mechanically connected to the gate. The actuator is pivotably secured to the spout of the gravity feed dispenser. The linkage is pivotably connected between the pair of handle arms and the lever arms of the actuator.

In an example of the method, the pivot housing is secured about the spout of the gravity feed dispenser. The actuator is pivotably secured to the pivot housing.

DETAILED DISCLOSURE

Figure 1:
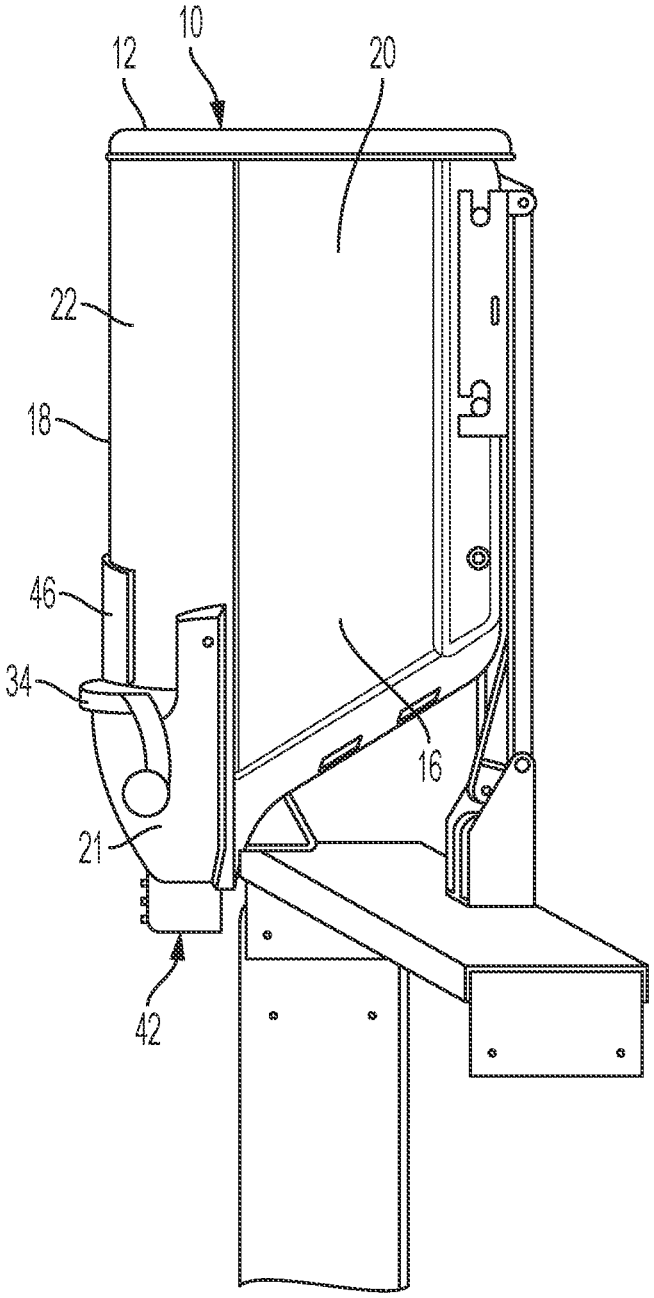
FIG. 1 PRIOR ART
FIG. 1 depicts a prior art bulk dispenser.

FIG. 1 presents an example of a currently available gravity feed bulk dispenser 10. In FIG. 1 right and left side pieces 14, 16, and a lid 12 interconnect to form an enclosure that defines a first cavity 20. The right and left side pieces 14, 16 and the front piece 18 interconnect to form an enclosure that defines a second cavity 21 and a third cavity 22. In operation, the first cavity 20 and the third cavity 22 are filled with a bulk product to dispense, while the second cavity 21 is filled with the same bulk product for display to the customer. In order to completely and effectively inform a customer about the bulk material, a printed display or sign can be held by a display holding device 46 located on an outside surface of the front piece 18.

A customer initiates the flow of the bulk product by actuating handle 34 in the direction of arrow 40. The customer holds a receptacle (not shown) below an outlet 42. The customer holds the handle 34 with one hand while holding the receptacle with the other. Actuation of the handle 34 opens a door (not depicted) internal to the bulk dispenser 10 connecting the first cavity 20 to the third cavity 22. Under the force of gravity, material flows from the first cavity 20, through the third cavity 22, out the outlet 42 and into the receptacle, in that order. After dispensing a desired amount of material into a receptacle, the customer releases handle 34 and biasing devices (not depicted) interact with the front piece 18 and the door to return the handle 34 back to the first position in which the rotating door separates the first cavity 20 from the third cavity 21, i.e. the normally closed position of the handle and door. As previously indicated, other examples of gravity feed bins are known and incorporated by reference in their entireties.

Consumers may use disposable, single-use receptacles (e.g. cups or bags) or may use reusable storage containers to collect the product dispensed from the dispenser. Some consumers and retailers find preference for this type of product sale as it generally requires less packaging and therefore less consumer waste. Further, due to supply chain efficiencies, the products can be sold at a more economical price than compared to pre-packaged portions. Lastly, some consumers may prefer the interactivity of the dispense of products from a bulk resource and the control over the volume of product acquired.

However, consumers and retailers have increased concerns regarding the potential for disease transmission by successive operations of these communally available dispensers. The interactivity of the operation of common bulk dispensers has consumers repeatedly placing their hands on the handles of the dispensers. This could potentially transfer microbes, viruses, and/or other disease vectors from one customer to a subsequent customer using that dispenser. Such transfer could occur across several customers across a series of transactions with the same dispenser. One way to limit this transfer potential is with protocols for cleaning, sanitation, and/or disinfection, which require schedules, supplies, and additional worker actions.

Figure 2:
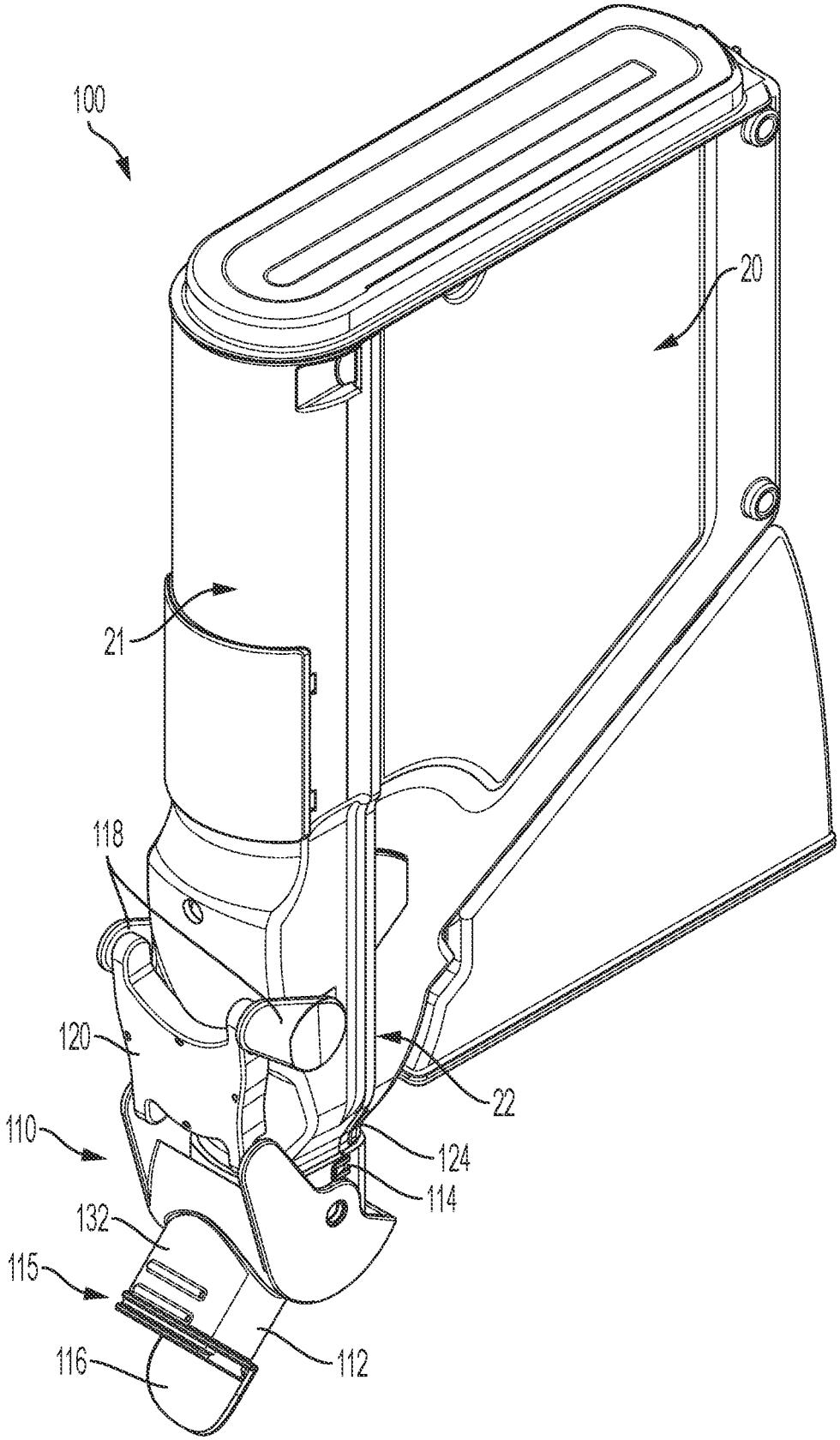
FIG. 2 is a perspective view of the bulk dispenser disclosed herein.
Figure 3:
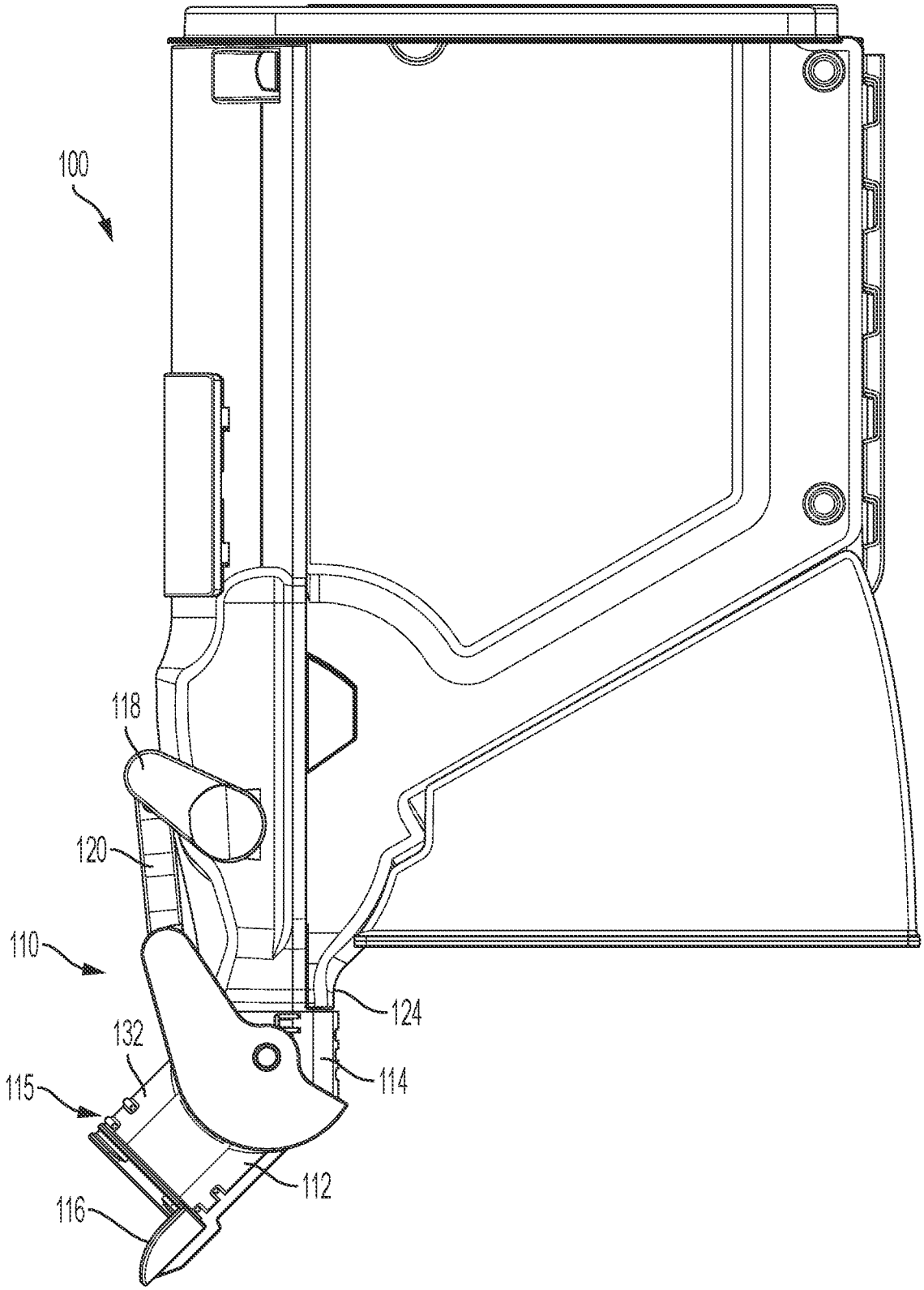
FIG. 3 is a side view of the bulk dispenser of FIG. 2.
Figure 8:
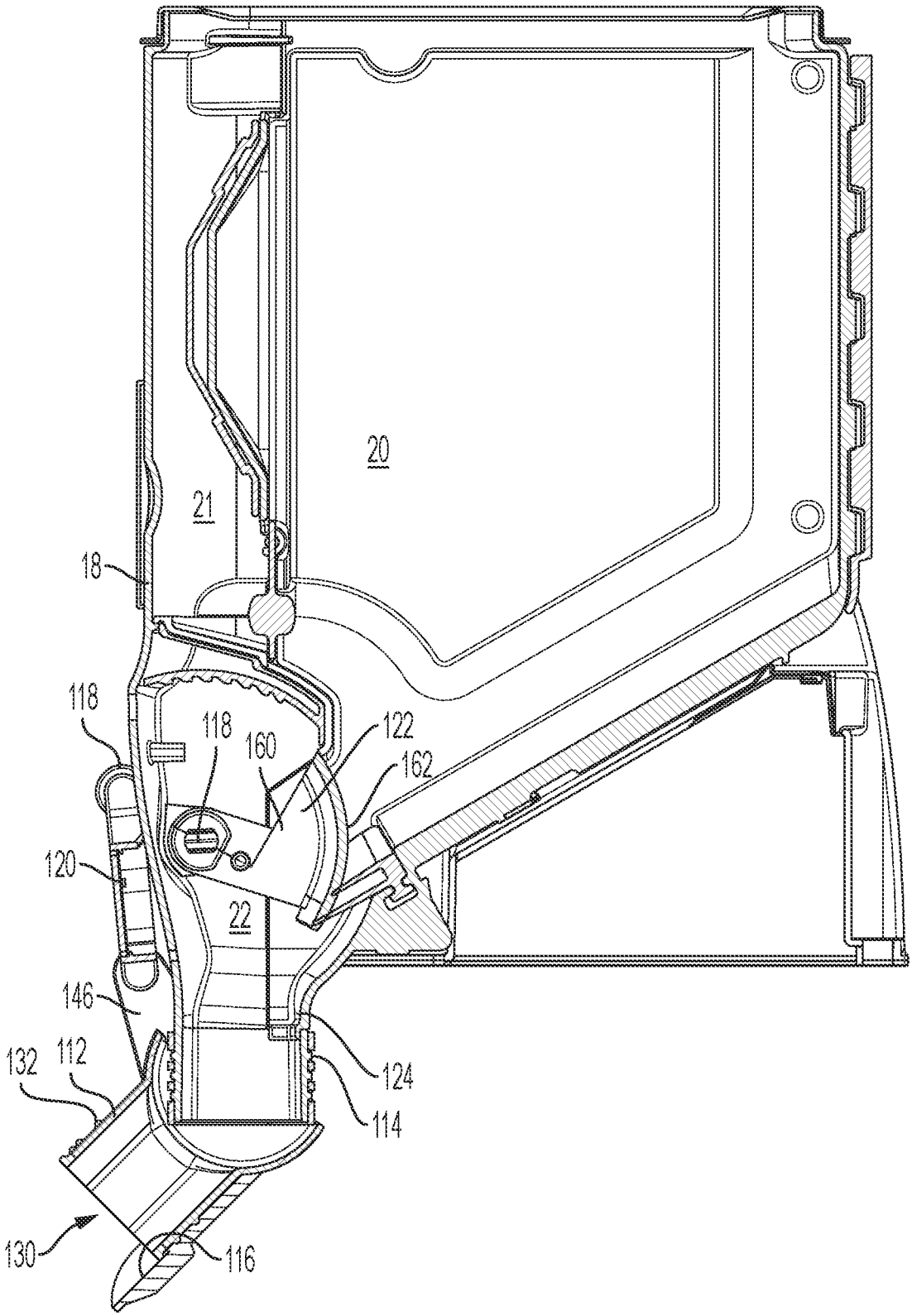
FIG. 8 is a cross-sectional view of the bulk dispenser of FIG. 3 in a closed condition.

FIG. 2 provides an example of a new gravity feed bulk dispenser 100 that solves the issues of the above concerns with currently available bulk dispensers. FIG. 3 is a side view of the same dispenser 100. FIG. 8 is a cross-sectional view of the dispenser 100 of FIG. 3. As described herein, the dispenser 100 is configured to actuate the dispense of bulk product with the use of the receptacle as the point of intermediate contact between the customer and the dispenser. Examples of the dispenser 100 provided herein may minimize the redundant touch of the dispenser 100 by successive customers. The dispenser 100 may ease operation of the dispenser by a customer to dispense product by enabling the user to use both hands to hold the receptacle to receive the bulk product and to actuate the dispense of the bulk product. This enables use of the dispenser by customers with a greater range of physical ability, either to use both hands for increased actuation force or to support the receptacle or to enable a single-handed operation for actuation and receptacle support.

The dispenser 100 exemplarily includes similar first cavity 20, second cavity 21, and third cavity 22 as described above. Such first cavity 20, second cavity 21, and third cavity 22 may be similarly defined by side walls 14, 16, front wall 18, and a lid 12 as described above as well. While it is recognized that these features may remain the same between the dispensers of FIGS. 1 and 2, it is also apparent from the present disclosure that the features of the actuator assembly 110 as described herein may be used with other examples of dispensers 100 while remaining within the scope of the present disclosure. The dispenser 100 includes an actuator assembly 110 that facilitates indirect operation of the actuator assembly by an operator of the dispenser 100. Instead, as explained herein, the actuator assembly 110 enables the receptacle to be used as the point of direct contact with the actuator assembly 110 and thus intermediate to the user and the actuator assembly 110.

The dispenser actuator assembly 110 includes a spout actuator 112 which rotates relative to a pivot housing 114. The pivot housing 114 is secured about a spout 124 of the dispenser 100. The spout actuator 112 exemplarily includes a tubular spout 132 and may optionally include a spout extension 116 that extends from the tubular spout 132 and faces the user. The spout extension 116 can help to direct the dispensed bulk product into the receptacle during dispense. The spout actuator 112 is connected to a pair of handle arms 118 by a linkage 120. The handle arms 118 are rotationally connected to the front wall 18 of the dispenser 100. As exemplarily depicted in FIG. 8, the handle arms 118 are connected to a gate 122 through the front wall 18. These features will be described in further detail herein with respect to FIG. 5.

Figure 4:
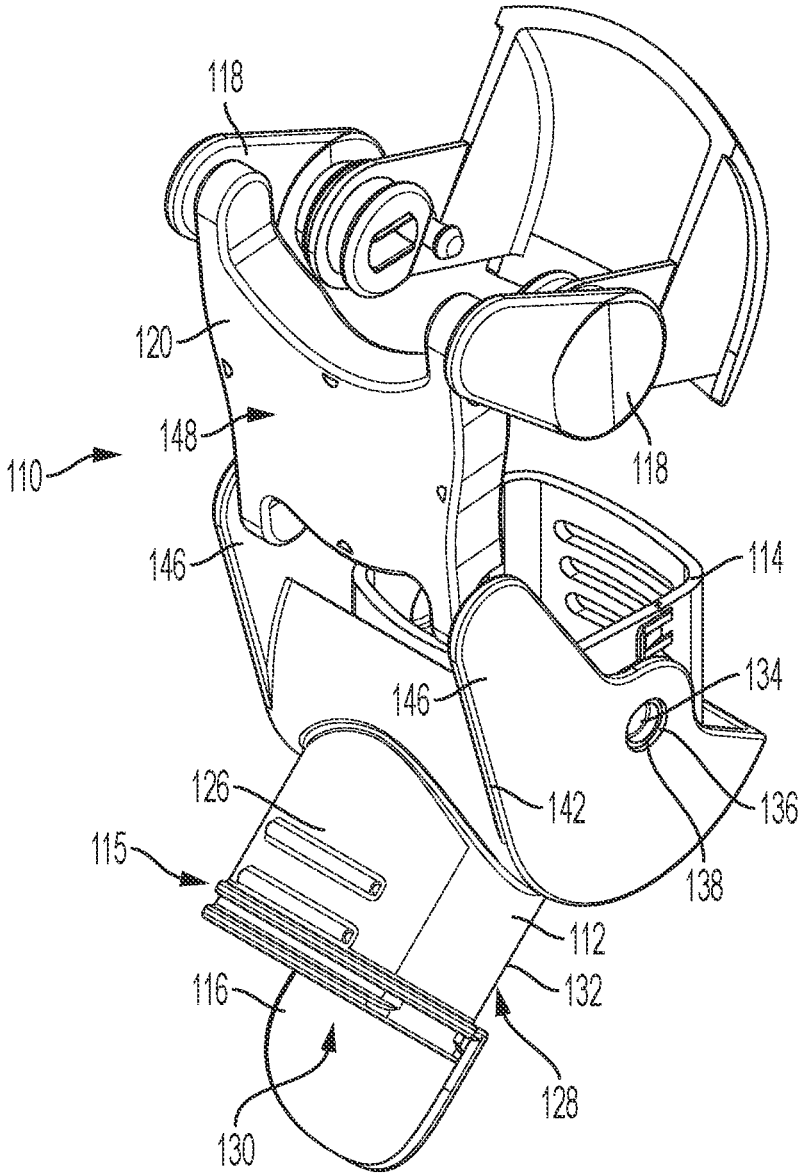
FIG. 4 is a detailed view of the dispensing assembly of the bulk dispenser of FIG. 2.
Figure 5:
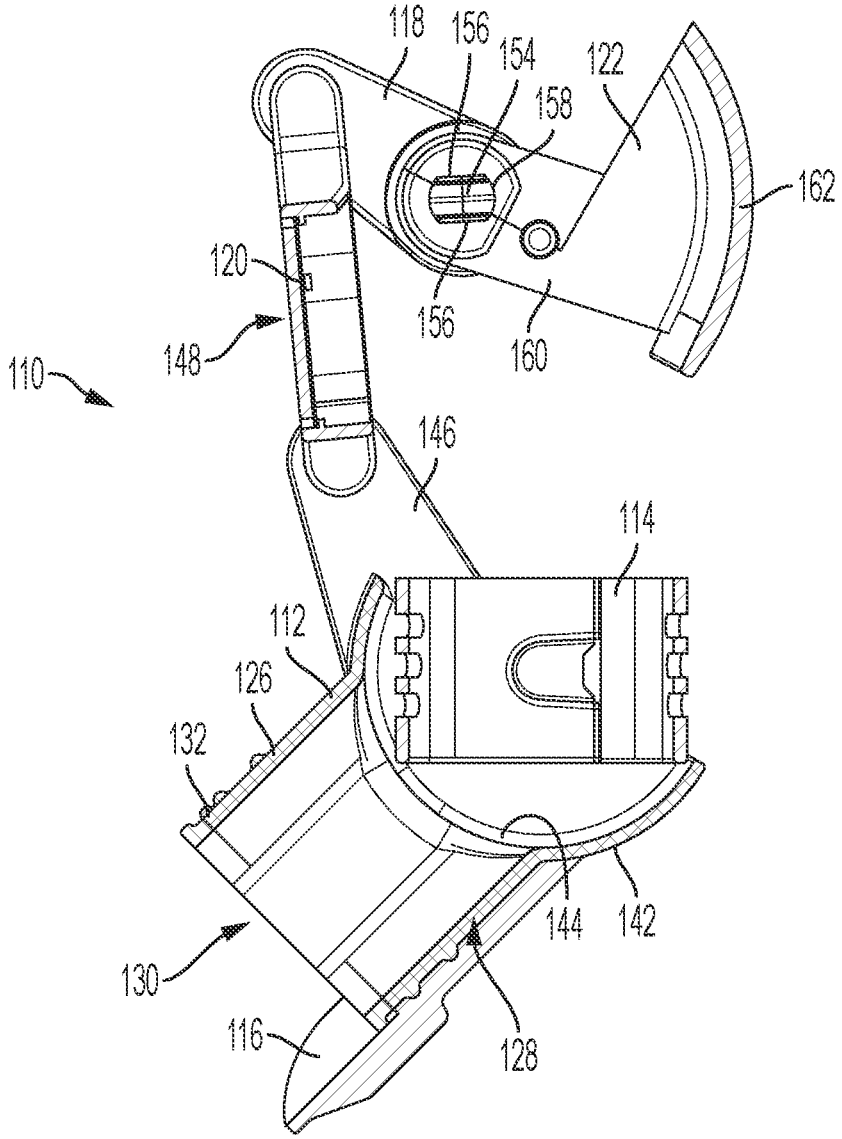
FIG. 5 is a cross-sectional view of the dispensing assembly of FIG. 4

FIG. 4 is a detailed view of the dispenser actuator assembly 110. FIG. 5 is a cross-sectional view of the dispenser actuator assembly 110 of FIG. 4. A hollow path is formed between the pivot housing 114 and the spout actuator 112. The dispensed product thus is able to flow out of the spout 124 (FIGS. 2, 3, 8, 9) and through the pivot housing 114 and the interior of the spout actuator 112 for dispense. The spout actuator has a tubular spout 132, exemplarily having a forward spout portion 126 and a rear spout portion 128. As will be explained in further detail herein, the operable force is placed on the spout actuator 112. This operable force is exemplarily placed on the forward spout portion 126. This can be applied with a receptacle (not depicted) as the intermediary between the user and the spout actuator 112. The receptacle can also surround the opening 130 of the spout actuator 112 to receive the dispensed product within the receptacle. The receptacle, for example, may be a jar placed about the entire spout actuator 112 or may be a pliable bag wrapped about the spout actuator 112. In either case, the receptacle provides the intermediate point of contact between the user and the spout actuator 112, and the receptacle, when in such point of intermediate contact, also surrounds the opening 130 of the spout actuator 112. As will be explained in further detail herein, the spout 132 may include a functional tip that facilitates engagement between the receptacle and the spout actuator 112. The functional tip may be a ridge or ridges 115 at the end of the spout 132 or may be a spout extension 116 as described herein. The functional tip may be integral to the spout 132 or may be a separate component attached to the spout 132. The optional spout extension 116 may help to direct the dispensed bulk product into the receptacle or form a lever for engagement of the receptacle against the spout actuator 112. As will be described in further detail herein, the spout actuator 112 may rotate to place the dispenser actuator assembly 110 into the open condition. This condition may place the tubular spout 132 in coaxial alignment with the spout 124 of the dispenser 100 (FIGS. 2, 3, 8, 9), while in other examples, the spout actuator 112 may remain at a forward acute angle relative to the spout 124. In such a case, the rear spout portion 128 and the optional spout extension 116 may further help to direct the bulk product into the receptacle.

Figure 7:
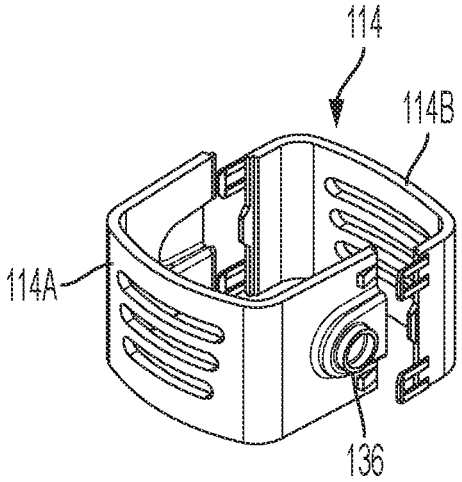
FIG. 7 is a detailed view of an example of a pivot housing.

The spout actuator 112 is pivotably secured to the pivot housing 114 at a pivot point 134. The pivot point may be defined by the interaction of an axle projection 136 from an exterior of the pivot housing 114 with an axle aperture 138 of the spout actuator 112. It will be recognized that other pivot connections between the spout actuator 112 and the pivot housing 114 may be made within the scope of the present disclosure. FIG. 7 provides a detailed view of an example of the pivot housing 114. The pivot housing 114 is exemplarily provided in two halves 114A, 114B which are joined by resilient connections 140. While the pivot housing 114 may be provided in other constructions, a multiple part construction may facilitate the connection of the pivot housing 114 about the spout 124 of the dispenser, for example in cases of a retrofit application of the actuator assembly 110. The resilient connections 140 may be provided by the obstruction and detent mechanisms as shown in FIG. 7. It will be recognized that in still further examples, the pivot housing 114 may be constructed unitarily with the spout 124, or portions of the spout 124 as such may be constructed.

Referring back to FIGS. 4 and 5, the spout actuator 112 further includes a spout actuator body 142. The spout actuator body 142 provides both the pivoting connection to the pivot housing 114 (e.g. in the form of the axle aperture 138 formed therein) and also connects to the tubular spout 132. An interior 144 of the spout actuator body 142 may exemplarily be curved to help to direct the bulk product into the tubular spout 132. Lever arms 146 extend away from the spout actuator body 142. While not depicted, the arms 146 include pivot projections or buttons which are configured to movably engage with the linkage 120. The linkage 120 exemplarily provides flat surface 148 upon which an informative label (not depicted) is placed. The informative label positioned on the linkage 120 thus removes the label which may otherwise be positioned on the front side 18 and block a consumer view of the bulk product displayed within the second compartment 21.

Figure 6:
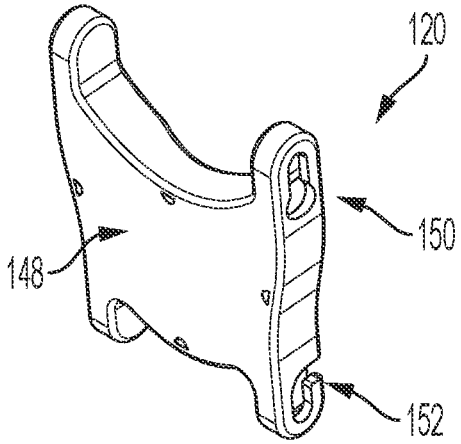
FIG. 6 is a detailed view of an example of the linkage.

FIG. 6 provides a detailed view of an example of the linkage 120, which includes upper keyhole slots 150 and lower keyhole slots 152. The lower keyhole slots 152 are configured to receive the pivot projections or buttons extending from the lever arms 146 of the spout actuator 112 to form a pivot connection 147. As will be described in further detail herein, the upper keyhole slots 150 are configured to receive pivot projections or buttons (not depicted) extending from the handle arms 118.

Referring back to FIGS. 4 and 5, the handle arms 118 are pivotably connected to the linkage 120 at the respective upper keyhole slots 150. While hidden from view, the handle arms 118 include pivot projections or buttons that extend inwardly from the handle arms 118 and pivotably engage the linkage 120 within the upper keyhole slots 150. The handle arms 118 further include projections 154 that extend inwardly from the handle arms 118. The projections 154 are configured to extend through the front wall 18 (See FIGS. 8 and 9) such that the handle arms 118 can pivot relative to the front wall 18 about the projections 154. The projections 154 terminate in resilient snaps 156 that are configured to engage the gate 122 through an engagement aperture 158 through an arm 160 of the gate 122. The gate exemplarily includes a rounded door 162 that faces the first compartment 20 and arms 160 that extend away from the door 162. Engagement of the resilient snaps 156 with the arms 160 through the engagement apertures 158 secures the gate 122 to the handle arms 118 and to the respective projections 154 of the handle arms 118. The gate 122 is thus pivotably connected relative to the front wall 18 by this engagement in a similar manner as the handle arms 118 are pivotably connected relative to the front wall 18. By way of this connection movement of the handle arms 118 to rotate at the projections 154 results in rotation of the gate 122 at the projections 154.

Figure 9:
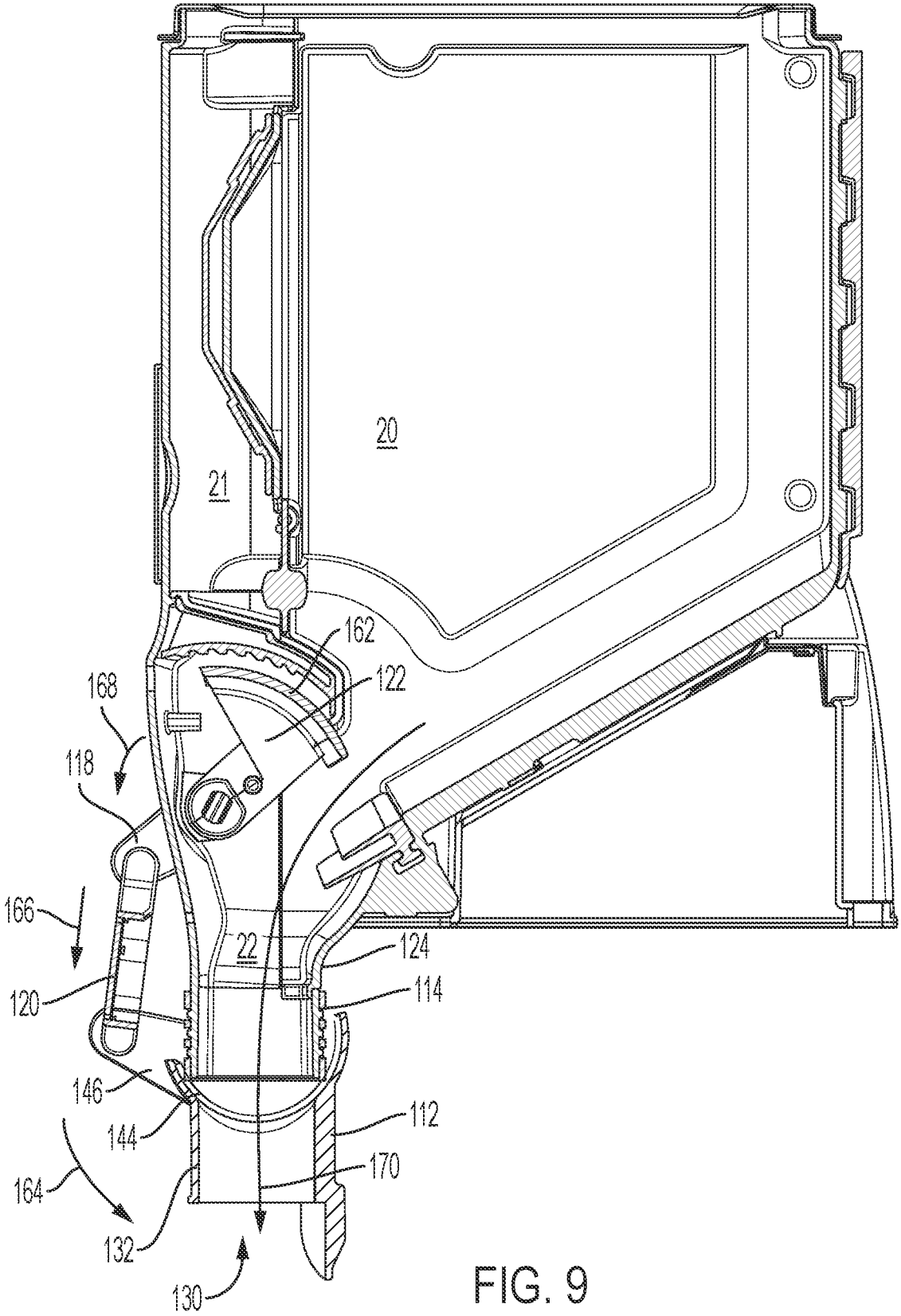
FIG. 9 is a cross-sectional view of the bulk dispenser of FIG. 3 in the open condition.

FIG. 8 is a cross-sectional view of the bulk dispenser 100 in a closed condition. FIG. 9 is a cross-sectional view of the bulk dispenser 100 in an open condition. During use of the bulk dispenser 100, the first compartment 20 is filled with the bulk product to be dispensed, for example, but not limited to, whole nuts, coffee beans, pasta, or candy. The gate 122 is positioned with the door 162 of the gate 122 separating the first compartment 20 from the third compartment 22 and preventing the bulk product from exiting the dispenser 100 through the opening 130. The user places a receptacle, which may, for example, be a jar or a plastic or paper bag about the tubular spout of the 132 and the opening 130 of the spout actuator 112. This positions the receptacle in a proper position relative to the opening 130 to receive the dispensed bulk product but also provides a barrier against direct contact by the user with the spout actuator 112 or any other part of the dispenser 100. Since each user only indirectly contacts the dispenser 100, sequential contact risk for transmission of contaminations including virus or bacterial contaminations is reduced or mitigated.

With the receptacle thus positioned relative to the spout actuator 112, the user placed a force upon the spout actuator 112 through the receptacle in the direction of arrow 164. This force rotates the spout actuator 112 about the pivot point 134 in the direction of arrow 164. This applied force is transferred through the connection of the lever arms 146 to the linkage 120 as described above, moving the linkage 120 in the direction of arrow 166. The movement of the linkage 120 in the direction of arrow 166 transfers the applied force to the handle arms 118, causing the handle arms 118 to rotate relative to the front side 18 about the projection 154 in the direction of arrow 168. Because of the engagement between the handle arms 118 and the gate 122 by way of the resilient snaps 156, the gate 122 rotates in the direction of arrow 168 along with the handle arms 118. This moves the door 162 of the gate 122 away from the compartment 20 opening the compartment 20 to the compartment 22 so that the bulk product from the compartment 20 can move by way of gravity along the path of arrow 170 out of the opening 130 into the receptacle.

Thus by way of the mechanical connections just described, the force on the spout actuator 112 indirectly applied by the user through the receptacle simultaneously moves the components of the spout actuator 112, linkage 120, handle arms 118, and gate 122 from the closed positions depicted in FIG. 8 to the open positions depicted in FIG. 9. To end the dispense of the bulk product, the components are moved back into the positions depicted in FIG. 8.

It will be recognized that the example just described is but one example and that other variations will be recognized based upon the disclosure provided herein. In some examples, the spout actuator 112 may rotate through 45 degrees, while in other examples it may be less than 45 degrees, exemplarily 25 degrees or 35 degrees, while in further examples, the spout actuator 112 rotates greater than 45 degrees, exemplarily 60 degrees. The spout actuator 112 may exemplarily end with the tubular body 132 in a vertical orientation relative to the spout 124, while in other examples, the spout actuator 112 may remain at an angle relative to the spout 124 when positioned in the open or dispensing configuration.

Figure 10A:
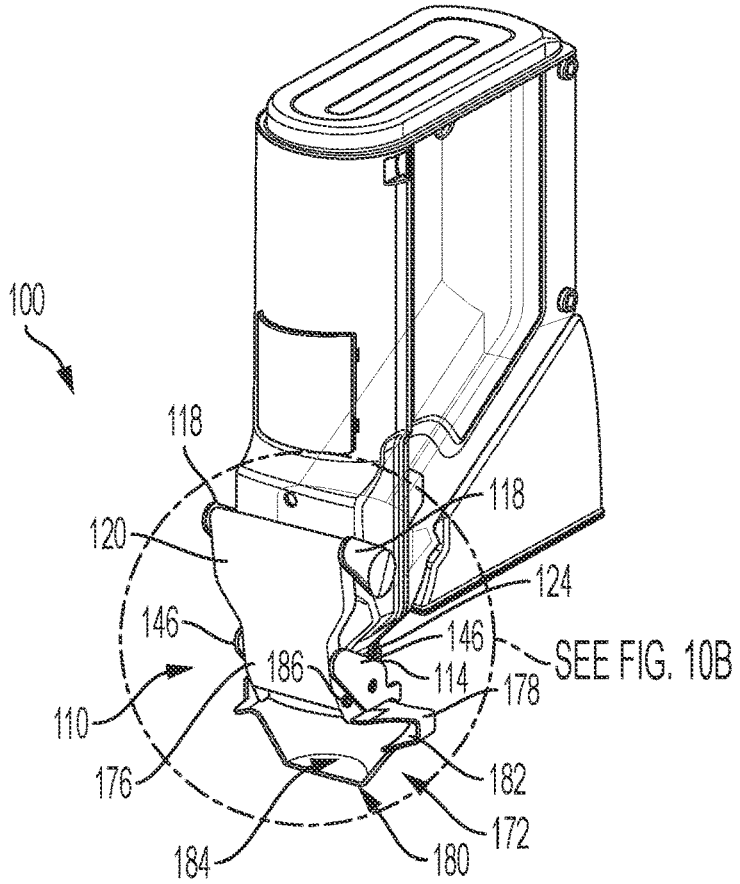
FIG. 10A is perspective view of the bulk dispenser of FIG. 2 with an example of a bowl adapter.
Figure 10B:
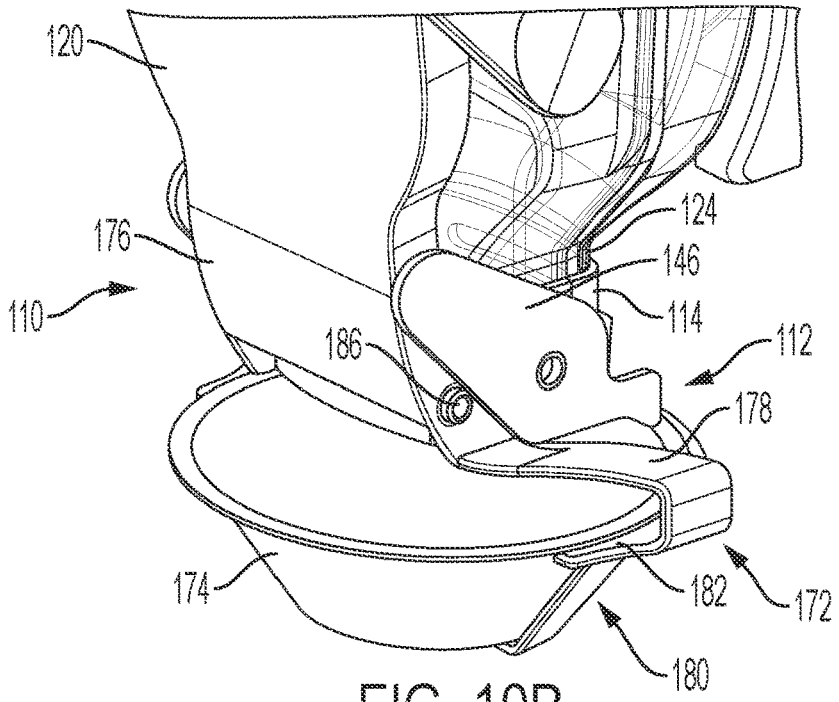
FIG. 10B is a detailed perspective view of the bulk dispenser with the bowl adapter in use with a bowl.

FIG. 10A is a perspective view of the bulk dispenser 100 with an example of a bowl adapter. FIG. 10B is a detailed perspective view as taken along line B-B of FIG. 10A. The dispenser 100 includes many of the same features as shown and described above with respect to FIGS. 2-9. The actuator assembly 110 includes a bowl adapter 172 is configured to engage with a bowl 174 (FIG. 10B). The user's bowl 174 can act as the point of indirect contact for actuating the actuator assembly 110 to dispense the bulk product into the bowl 174. One example of the use of this configuration of dispenser is for the dispense of dry cereal in a hospitality or buffet setting. The example of the bowl adaptor 172 shown in FIGS. 10A and 10B includes an extension portion 176 that extends downward from the linkage. Arms 178 extend outward from the extension portion 176. A bowl tray 180 is suspended from the arms 178. The bowl tray 180 includes a lip 182 and sides and a bottom that define a depression 184. The depression 184 and the lip 182 are configured to engage the bottom, sides, and lip of a corresponding bowl 174 to receive the bulk product. The bowl tray 180 is configured to engage approximately half of the bowl, or for example, is semi-circular in shape. A semi-circular or approximately semi-circular shape of the bowl tray 180 provides an opening between the sides of the bowl tray 180 dimensioned to receive the diameter of the bowl and is configured for engagement with approximately half of the bowl 174.

The extension portion 176 further includes projections 186 that extend laterally away from the extension portion 176 at locations below the pivot connections 147 between the actuator 112 and the linkage 120. The projections 186 are configured to engage the lever arms 146 of the actuator 112 to help to define the closed or resting position of the actuator assembly 110.

In operation, a user positions a bowl 174 through the opening in the bowl adapter (between the arms 178 and the bowl tray 180 and places a downward force on the bowl 174. This force is transferred to the bowl tray 180 and the linkage 120, pulling the linkage 120 down and the gate (122 FIGS. 8, 9) into the open position. The actuator 112 provides the pivoting connection between the linkage 120 and the spout 124, to guide the bowl tray 180, and the bowl 174 engaged therewith, generally vertically downwards to a position below the spout 124. With the bowl 174 in this position and the gate 122 in the open position, the bulk product is dispensed into the bowl 174.

Figure 11A:
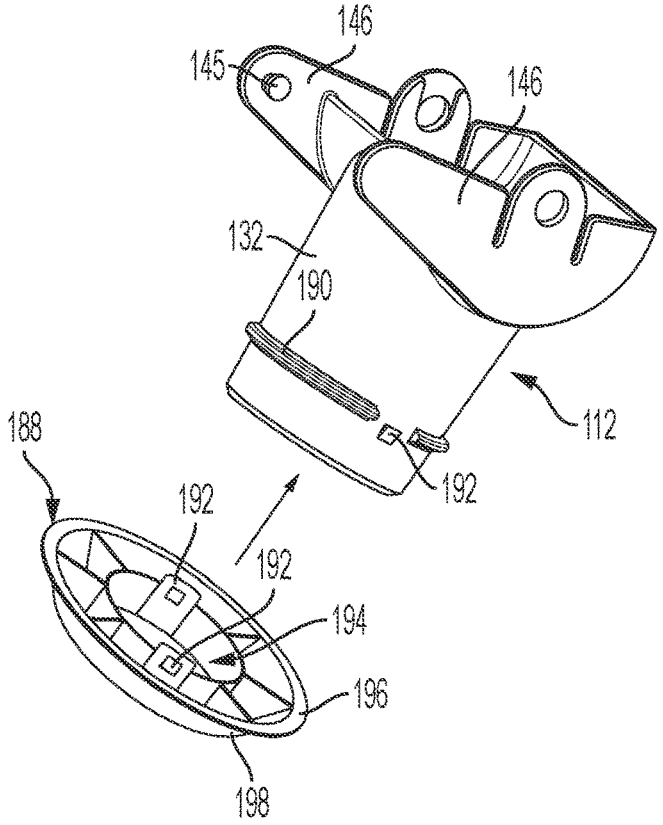
FIG. 11A is an exploded view of another example of a bowl adapter.
Figure 11B:
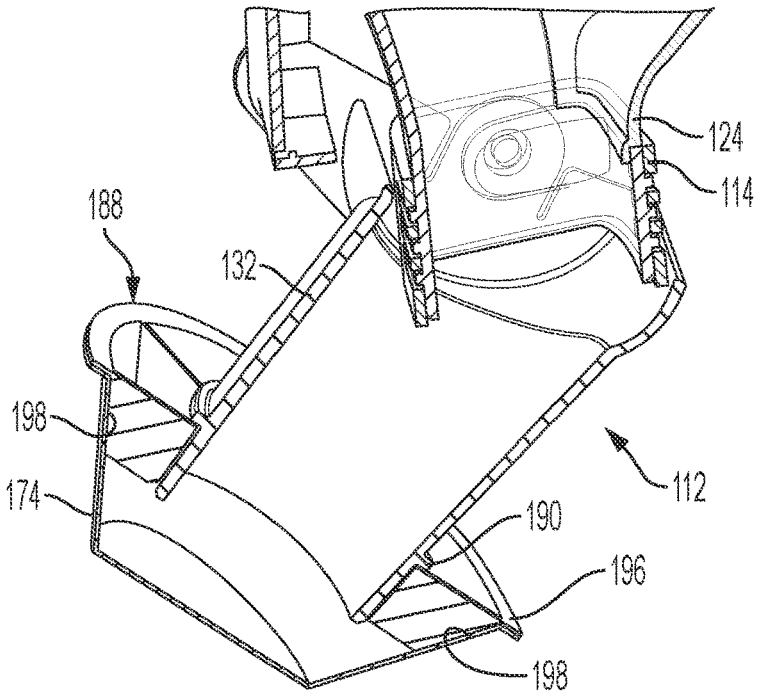
FIG. 11B is a detailed cross-sectional view of the bulk dispenser with the bowl adapter in use with a bowl.

FIGS. 11A and 11B present another example of a bowl adapter 188 which is configured to facilitate engagement between the actuator assembly 110 and a receptacle in the configuration of a bowl 174. The bowl adapter 188 is configured as a replaceable functional tip that can be secured to the end of the spout 132 of the actuator 112. FIG. 11A is an exploded view of the actuator 112 and the bowl adapter 188 and FIG. 11B is a detailed cross-sectional view of a portion of the dispenser 100 with the bowl adapter 188 in use with a bowl 174. In examples, the bowl adapter 188 may be used with a dispenser 100 as described above with respect to FIGS. 2-9. The spout 132 of the actuator 112 may include a lip 190 and at least one engagement feature 192. The bowl adapter 188 is annular in shape, with an aperture 194 configured to receive and match the spout 132. Corresponding at least one engagement feature 192 on the bowl adapter 188 are configured to engage with the at least one engagement feature 192 of the actuator 112. It will be recognized that various forms of engagement features, including but not limited to ratchets, friction fit, deforming tabs/fingers, threaded connections, bayonet projections, or others may be used within the scope of the present disclosure. When secured to the spout 132, the bowl adapter 188 exemplarily terminates at the end of the spout 132, such that the aperture 194 is co-extensive with the opening 130.

The bowl adapter 188 includes a lip 196 and an exterior side wall 198. The lip 196 and the sidewall 198 are exemplarily circumferential and define respective outer extents of the bowl adapter 188. As shown in FIG. 11B, the lip 196 is configured to engage a top surface of a lip of the bowl 174, which, in an example, may be the top edge of the bowl wall. The sidewall 198 of the bowl adapter is configured to engage the inner surface of the bowl wall. With engagement between the bowl 174 and the bowl adapter 188, the user can place an indirect force on the actuator 112 through the bowl 174 to move the dispenser actuator assembly 110 from the closed position to the open position in the manner as described above with respect to FIGS. 2-9 to dispense the bulk product into the bowl 174.

Figure 12:
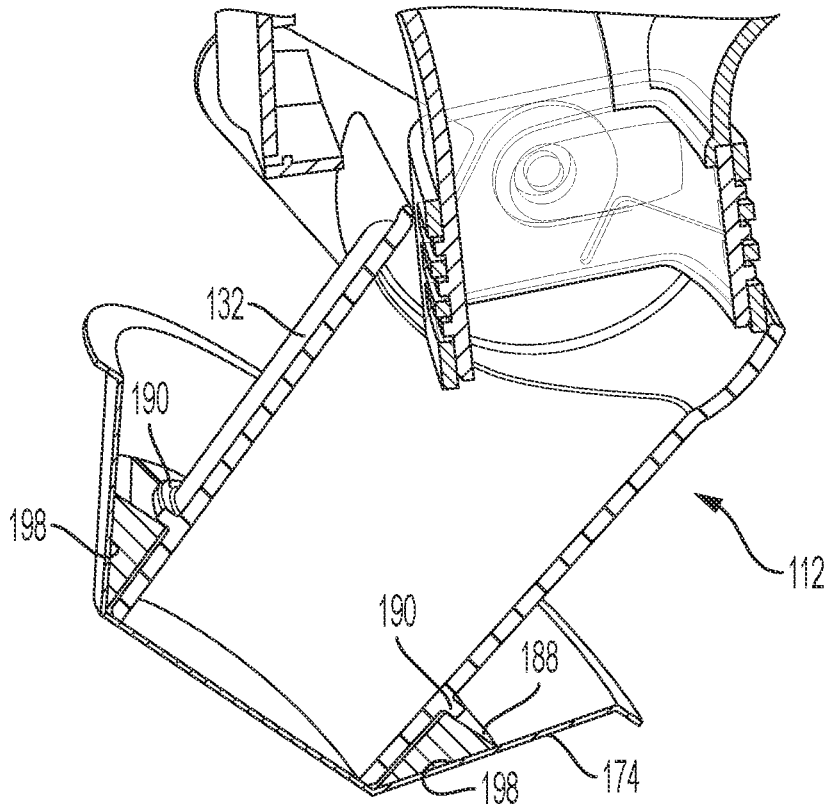
FIG. 12 is a detailed cross-sectional view of the bulk dispenser with another example of a bowl adapter in use with a bowl.

FIG. 12 is a detailed cross-sectional view of a portion of the bulk dispenser 100 another example of the bowl adapter 188. The bowl adapter 188 is exemplarily configured in the same manner as described above with respect to FIGS. 11A and 11B. The bowl adapter 188 as shown in FIG. 12, does not include the lip 196, such that the bowl adapter 188 is configured to engage the bottom of a bowl 174, as well as the sides of the bowl as described above with the sidewall 198 of the bowl adapter 188.

The bowl adapters 188 may be integrally formed with the spout actuators 112 or may be separate pieces as shown in FIGS. 11 and 12, configured for selective or removable attachment to the spout actuator. In an example, the bowl adapter may include a deformable keyway or opening which can flex to move around and engage with one or more tabs on the spout actuator. In other examples, these components may be reversed. Other manners of engagement, including but not limited to friction fit, bayonet, and threaded features may also be used or recognized as being within the scope of the present disclosure.

Figure 13A:
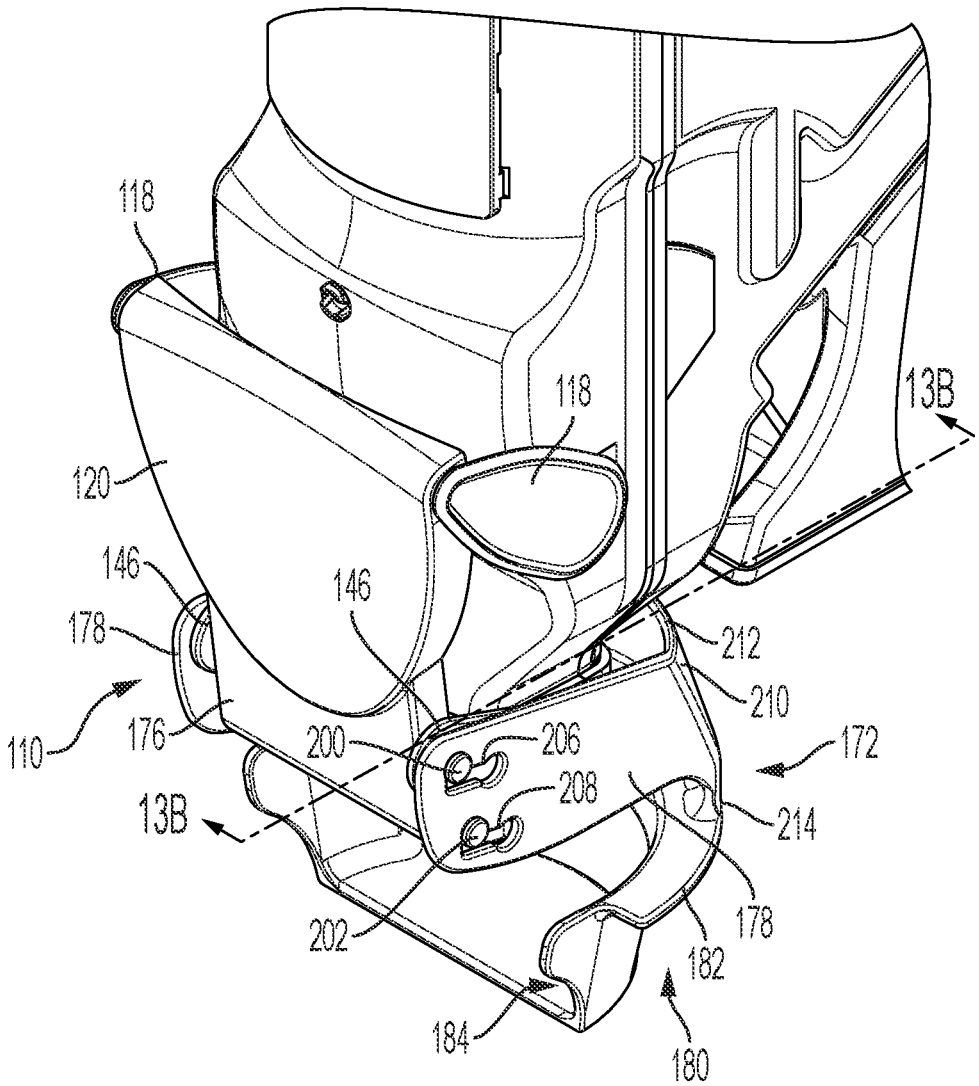
FIG. 13A is a detailed perspective view of a further example of a bowl adapter.
Figure 13B:
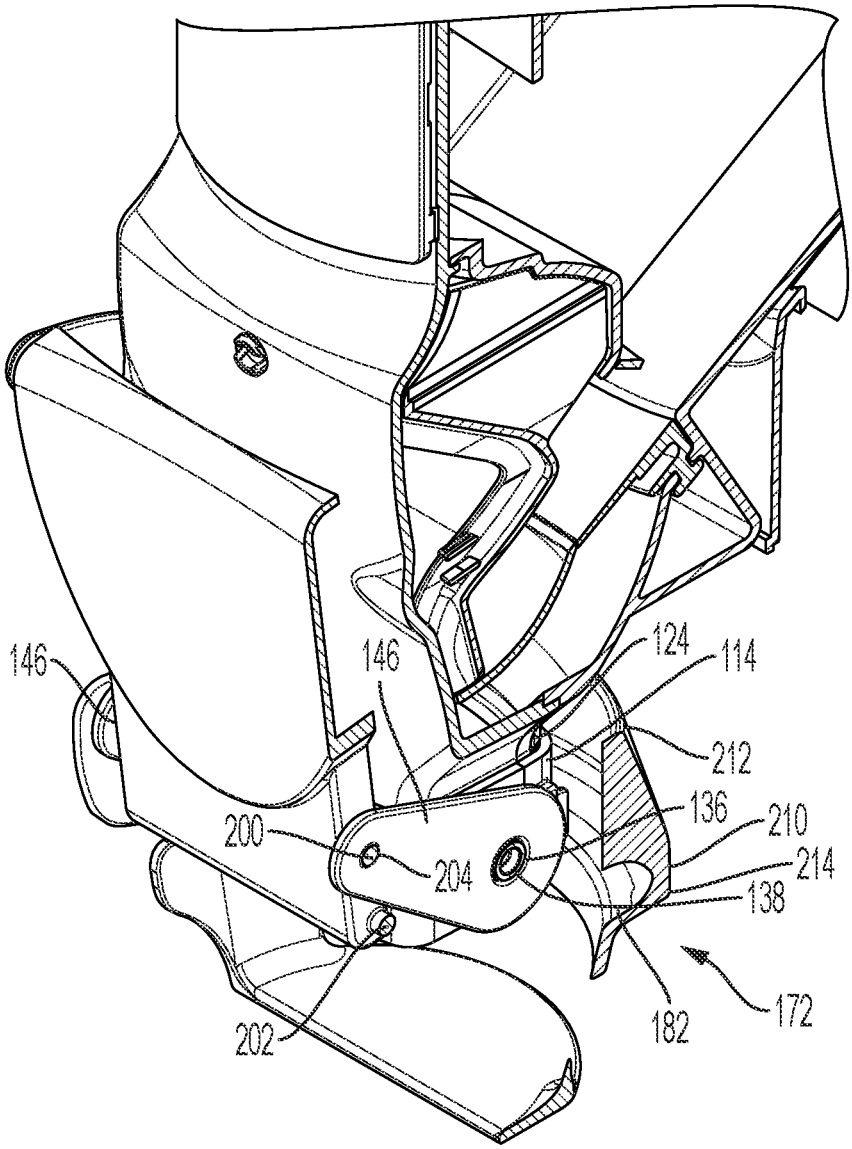
FIG. 13B is a detailed perspective sectional view taken along line B-B of FIG. 13A.

FIGS. 13A and 13B present another example of a bowl adapter, similar to that as shown and described above with respect to FIGS. 10A and 10B. FIG. 13B is a cross-sectional detailed perspective view taken along line B-B of FIG. 13A. Instead of the bowl adaptor 172 being integral with the linkage 120, the bowl adaptor 172 is a separate component connected to the linkage 120 and also connected to the lever arms 146. The lever arms 146 include projections (see e.g. projection 145 FIG. 11A) which pivotably connect the lever arms 146 to the linkage. The lever arms 146 further include projections 200 that share a common rotational axis with the projections 145 and projections 200 extend laterally away from the lever arms 146 opposite the projections 145. The linkage further includes projections 202, which extend laterally away from the linkage 120. The axle projection 136 of the pivot housing 114 extends through the axle aperture 138 of the lever arm 146. The lever arm 146 thus rotates about the axle projection 136 as the projection 145 moves with the linkage 120.

The bowl adapter 172 includes arms 178 which connect to the linkage 120 and to the lever arms 146. Apertures 206, 208 are exemplarily formed as keyway apertures and are configured to receive projection 200 from the lever arm 146 and projection 202 from the linkage 120, respectively. The projections 200, 202 exemplarily include flanged tops and a portion of the apertures 206, 208 are enlarged to receive the respective flanged tops, while the projections 200, 202 may mechanically come to rest within a narrower portion of the apertures 206, 208, to secure the bowl adapter 172 to the linkage 120. The projection 200 of the lever arm 146 in combination with the projection 145 of the lever arm defines a common connection axis of respective points of the linkage 120, lever arm 146, and the arm 178. In an example, because the bowl adapter 172 is connected to the linkage 120 at four points (e.g. the opposite side of the actuator assembly 110 than pictured in FIGS. 13A and 13B mirrors the depicted side), the bowl adapter 172 and the linkage 120 move in conjunction with one another. The lever arms 146 move (connected at the common axis provided by the projection 145 and projection 200) relative to the linkage 120 and the bowl adapter 172 about the axle projection 136.

The bowl adapter 172 includes a bowl tray 180 which includes a lip 182 and sides and a bottom that define a depression 184. The depression 184 and the lip 182 are configured to engage the bottom, sides, and lip of a corresponding bowl (not depicted) to receive the bulk product. The bowl tray 180 is configured to engage approximately half of the bowl, or for example, is semi-circular in shape. A semi-circular or approximately semi-circular shape of the bowl tray 180 provides an opening between the sides of the bowl tray 180 dimensioned to receive the diameter of the bowl and is configured for engagement with approximately half of the bowl.

The arms 178 extends rearward from the linkage and laterally exterior of the spout 124. As described above, the arms 178 are also positioned laterally exterior of the pivot housing 114 and the lever arms 146. That is, the lever arms 146 move in a plane between the spout 124 and the arms 178. The arms 178 further connect to a dispensing shield 210. The dispensing shield 210 extends downward from the arms 178 and connects the arms 178 to the bowl tray 180, and specifically to the lip 182 of the bowl tray 180. The dispensing shield 210 is exemplarily partially frustoconical in shape, flaring radially outward such that a radius of the shield 210 is smaller at an edge 212 than at a base 214 where the dispensing shield 210 connects to the exterior of the lip 182.

In operation, the user positions a bowl within the bowl tray 180 and places a downward force on the bowl. This downward force is transferred through the bowl adapter 172 and the linkage 120 to the handle arms 118 to open the gate to dispense the bulk product. The lever arms 146 rotate with the linkage 120 and the bowl adapter 172 to define the position of the bowl adapter 172 relative to the spout 124 of the dispenser. In the dispensing position, the bowl tray 180 is located below the spout 124. In the dispensing position, the edge 212 of the shield 210 is positioned proximate to the opening 42 of the spout 124, and the shield 210 helps to direct dispensed bulk product from the spout 124 into the bowl in the bowl tray 180.

Figure 14A:
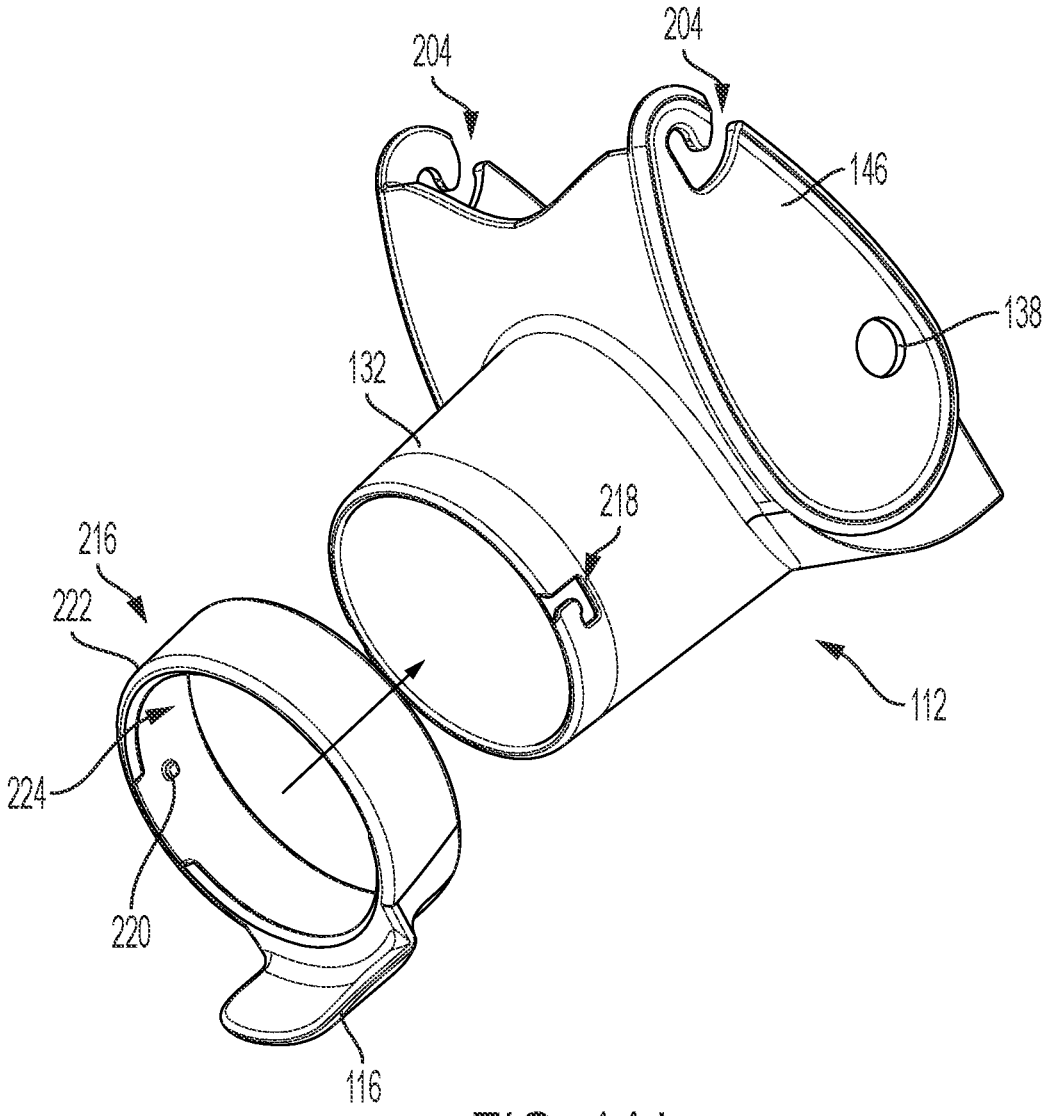
FIG. 14A is an exploded view of an example of a spout actuator and a spout tip.
Figure 14B:
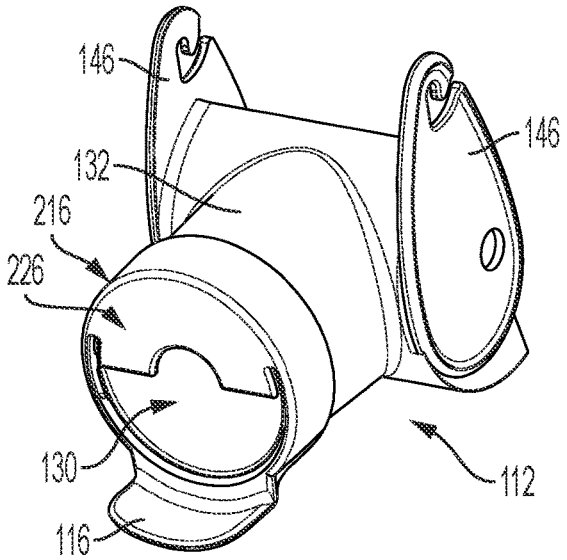
FIGS. 14B-D present additional examples of spout tips on a spout actuator.
Figure 14C:
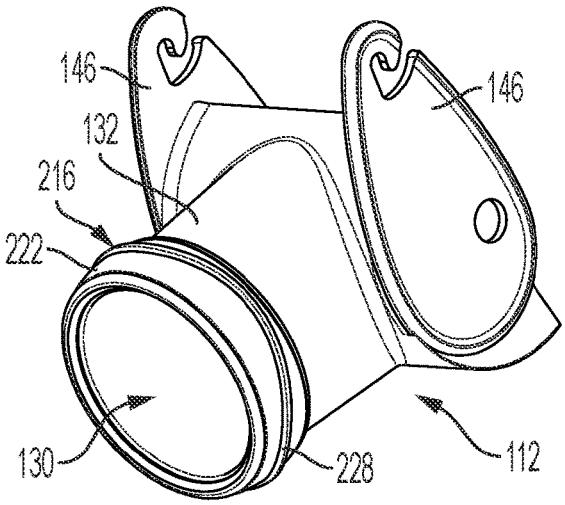

FIG. 14A is an exploded view of an example of a spout actuator 112 and a spout tip 216. FIGS. 14B-C present additional examples of spout tips on a spout actuator. It will be recognized that the examples of the spout tips 216 described herein are merely exemplary and also include the features of other functional tips as previously described herein. The spout actuator 112 provides an example of the pivot aperture 204. In the example shown, the pivot aperture 204 can be in the form of a keyhole slot, which would be configured to receive a projection from the linkage, as described above, or in a reversal of the example shown with respect to FIGS. 5 and 6.

In FIG. 14A, the spout actuator 112 is shown as a separate component from the spout tip 216. The spout tip 216 includes a spout extension 116 as described above with respect to FIG. 2. The spout extension 116 for example provides a point of contact between a receptacle, for example, a jar, and the spout actuator 112 and acts as a lever through which the user applies the opening force through the receptacle to the spout actuator 112. The spout extension 116 is exemplarily positioned below the opening 130 of the spout 132, to facilitate engagement of the spout extension 116 with an exterior of the receptacle, while creating alignment between an opening (interior diameter) of the receptacle with the opening 130 and the interior surface 224 of the spout tip 216. The spout tip 216 includes a body 222 that is exemplarily an annulus that is configured to secure about an exterior of the spout 132. It will be recognized that the shape of the spout tip 216 may be another shape consistent with the shape of the spout 132, for example, but not limited to, square, rectangular, or ovoid. As noted, the spout tip 216 is removably attachable to the spout 132. In the example shown, the spout 132 includes a keyway 218 in the shape of a bayonet connection. The keyway 218 is configured to receive a locking projection 220 located on an interior surface 224 of the spout tip 216. In the example shown, the locking projection 220 is received within a keyway 218 as the spout tip 216 is translated over the spout 132. The spout tip 216 is then rotated about the spout 132 to lock the projection 220 within the keyway 218, releasably connecting the tip 216 to the spout 132. It will be recognized that examples may have one or more sets of locking projections 220 and matching keyways 218 to secure the spout tip 216 to the spout 132. It will also be recognized that the releasable connection interface between the tip 216 and the spout 132 may be other forms of connections including but not limited to ratchets, friction fit, deforming tabs/fingers, threaded connections, or others may be used within the scope of the present disclosure.

Figure 14D:
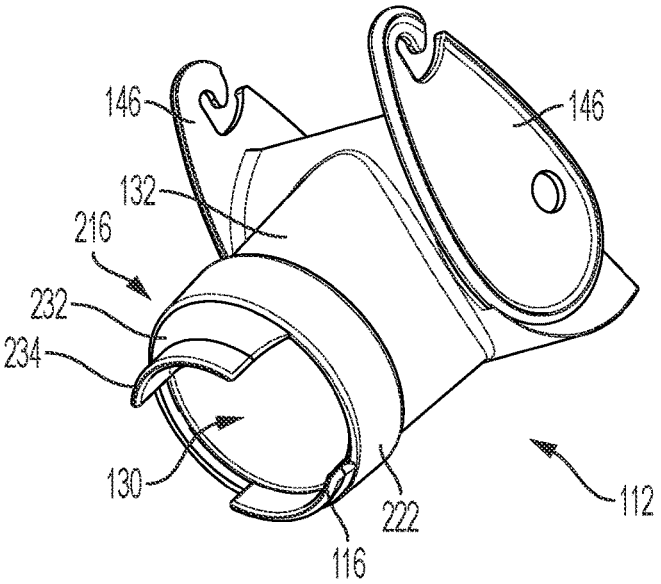

FIGS. 14B-14D provide still further examples of configurations of the tips 216 as may be connected to the 132 of the actuator 112. In FIG. 14B, the tip 216 exemplarily includes a spout extension 116 for engagement with the exterior of a receptacle as described above, but further includes an opening wall 226 that extends from the body 222 of the tip 216 partially across the opening 130 of the spout 132. The configuration provided in FIG. 14B is exemplarily operable for use with smaller diameter jars or receptacles, for example, cup or pint-sized containers. The opening wall 226 reduces the cross-sectional area of the opening 130 to limit the flow of the bulk product which may facilitate filling smaller containers while maintaining the spout 132 and the actuator 112 at a standardized shape and size.

FIG. 14C presents an example of a tip 216 with a rib or ridge 228 extending from the body 222. The rib or ridge 228 may exemplarily be a plurality of such structures, and may only extend partially about the circumference of the tip 216 as opposed to that depicted in FIG. 14C. Additionally, the rib or ridge 228 and/or a contact surface 230 of the tip 216 may be constructed of an elastomeric or polymeric material, such that the contact surface 230 exhibits a degree of deformation under force or contact. In an example, the contact surface 230 may be a different material from the body 222 and inset into the body 222. The material of the contact surface and/or the rib or ridge 228 may exemplarily facilitate engagement of the actuator 112 with a receptacle that is a reusable or single-use bag, and which may facilitate a user gripping the actuator 112 with indirect contact through the receptacle to operate the actuator 112.

FIG. 14D presents a further example of a tip 216 that includes a spout extension 116 that is configured for engagement of the exterior of a receptacle as described above but also includes a spout flange 232 that extends outward from the body 222 of the tip 216. The spout flange 232 exemplarily curves from the radius of the body 222 of the tip 216 to an outer edge 234 curved with a radius smaller than the radius of the body 222, or that of the opening 130. The spout flange 232 is exemplarily configured to engage an interior surface of the receptacle. That is, the spout flange 232 is configured to be inserted into an opening of the receptacle and the user translates the operable force indirectly to the actuator 112 through the receptacle by engagement of the spout flange 232 with the interior of the receptacle and engagement of the spout extension 116 with the exterior of the receptacle.

In examples as provided herein, the dispenser actuator assembly 110 is exemplarily provided as a retrofittable component package suitable for modification of existing gravity feed bulk dispensers 10 as are currently available, for example as described above with respect to FIG. 1. The disclosed dispenser actuator assembly 110 for example, may replace the corresponding handle and/or gate component of the existing dispenser. In one example, to retrofit the dispenser 10 of FIG. 1 to the dispenser 100 of FIG. 2, the handle 34 is removed. Handle arms 118 are connected through the through holes previously used by the handle 34 and connected to gate assembly positioned therein. In an optional example, the gate assembly 122 may also be replaced interior of the dispenser between the first cavity 20 and the third cavity 22. A pivot housing 114 is secured about the spout defining the opening 42 at the bottom of the third cavity 22. A spout actuator 112 is pivotably connected to the pivot housing 114. The linkage 120 is connected between the handle arms 118 and the spout actuator 112. In a still further example, it will be recognized that the features of the pivot housing may be instead incorporated directly into the spout, without the need for a separate component.

In another example, the linkage operatively between the gate and the spout actuator may be routed internally to the spout. In such an example, the linage may comprise two linage bars that are each secured to an internally routed gate axle from which arms extend. The spout actuator may be pivotably secured to the spout or the pivot housing with locking axles that extend through the spout actuator and through the spout interior of the spout. The locking axles may connect to linkage actuator arms. The linkage bars extend between the arms of the gate axle and the linkage actuator arms. The linkage bars transfer movement of the spout actuator to the gate to open and close the gate.

In still further examples, a handle may be actuated by the receptacle placed in contact with the handle, the handle actuated by rotation or translation to open the gate inside the dispenser, dispensing the product into the receptacle. An example of such handle may include a funnel. The receptacle (e.g. a single-use bag or a reusable jar) is placed about the funnel, and the user transfers force through the receptacle to the funnel and the rest of the handle. This rotates the handle, which opens the gate on the inside of the dispenser while rotating the funnel into position below the spout so that the receptacle receives the dispensed product. It has been discovered that a challenge is presented to achieve alignment of the funnel with the spout in coincidence with the gate opening. In still other examples, other arrangements of mechanical connection between the door and the handle may be used. In one example, the handle may rotate about a separate pivot point secured to the spout and apart from the pivot point of the gate. Gearing between the handle and the gate may reduce an angle through which the handle must rotate, and keep the handle and funnel in alignment with the spout. In another example, the handle and funnel may remain in alignment with the spout, but the handle moves vertically to actuate the gate.

In a still further example, the handle is integrated with the spout. The handle rotates the entire spout to actuate the gate. This example, along with others in this disclosure can be reversed in actuation, for example, may be configured to actuate on either a push or a pull rotation. In an example, a consumer rotates the spout towards themselves, to a point at which the angle of the spout matches the angle of the bin chute, this directs the product past the gate and through the spout into the receptacle.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives, and modifications are possible within the scope of the appended claims.

This written description uses examples to disclose the invention, including the best mode, and also to enable any person skilled in the art to make and use the invention. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A gravity-feed dispenser for storage and dispensing of bulk material, the gravity-feed dispenser comprising:

a compartment configured to receive and store bulk material;

a spout connected at one end to the compartment and open at a dispensing end;

a gate separating the compartment from the spout, the gate operable to open and close to selectively permit bulk material to pass from the compartment into the spout;

an actuator comprising a spout and pivotably connected to the spout of the dispenser at a first axis and the actuator is mechanically connected to the gate such that movement of the actuator operates the gate to rotate about a second axis to reversibly open and close, and concurrently reversibly positions the actuator to a dispensing position wherein the spout of the actuator is positioned below the dispensing end of the spout of the dispenser, wherein dispensed bulk material passes from the spout through the actuator, wherein the first axis is vertically separated from the second axis.

2. The gravity-feed dispenser of claim 1, further comprising a pivot housing releasably secured about the spout of the dispenser, wherein the actuator is pivotably secured to the pivot housing.

3. The gravity-feed dispenser of claim 1, further comprising:

at least one handle arm mechanically connected to the gate, wherein the at least one handle arm and the gate rotate about the second axis with respect to the compartment to open and close the gate; and a linkage pivotably connected between the at least one handle arm and the actuator.

4. The gravity-feed dispenser of claim 3, further comprising a tip removably connected to the spout of the actuator, the tip configured to engage a receptacle configured to receive dispensed bulk material.

5. The gravity-feed dispenser of claim 3, wherein the at least one handle arm is a pair of handle arms with a first end of the linkage pivotably secured between the pair of handle arms, and wherein the actuator comprises a pair of lever projections that extend from the actuator, a second end of the linkage pivotably secured between the pair of lever projections.

6. The gravity-feed dispenser of claim 5, wherein a force applied to the actuator rotates the actuator about the first axis relative to the spout of the dispenser and the force is transferred to the gate through the linkage and the pair of handle arms to open the gate.

7. The gravity-feed dispenser of claim 3, wherein the linkage comprises identifying information regarding the contents of the dispenser.

8. The gravity-feed dispenser of claim 1, further comprising a tip removably connected to the spout of the actuator, the tip configured to engage a receptacle configured to receive dispensed bulk material.

9. The gravity-feed dispenser of claim 1, further comprising a bowl adapter secured about the spout of the actuator.

10. The gravity-feed dispenser of claim 9, wherein the bowl adapter defines an aperture configured to receive the spout of the actuator and the bowl adapter further comprises an inwardly slanted side wall configured to engage a surface of a bowl.

11. The gravity-feed dispenser of claim 10, wherein the bowl adapter further comprises a lip that extends outward from the inwardly slanted side wall and is configured to engage a surface of the bowl, and wherein the bowl adapter and the spout of the actuator further comprise engagement features configured to retain the bowl adapter in engagement with the spout of the actuator.

12. The gravity-feed dispenser of claim 1, further comprising a bowl adapter secured the actuator, wherein the bowl adapter is configured for engagement with a bowl.

* * * * *